United States Patent [19]

Fujii et al.

[11] 4,310,383

[45] Jan. 12, 1982

[54] CONTINUOUS COUNTERCURRENT PRETREATMENT OF LIGNOCELLULOSE WITH ANTHRAQUINONE PRIOR TO PULPING

[75] Inventors: John S. Fujii; William G. Whalley, both of Vancouver; Fred L. Schmidt, Camas, all of Wash.

[73] Assignee: Crown Zellerbach Corporation, San Francisco, Calif.

[21] Appl. No.: 205,848

[22] Filed: Nov. 10, 1980

Related U.S. Application Data

[63] Continuation of Ser. No. 97,076, Nov. 23, 1979, abandoned.

[51] Int. Cl.[3] ..... D21C 3/02; D21C 3/20; D21C 11/00

[52] U.S. Cl. ..... 162/37; 162/40; 162/72; 162/90

[58] Field of Search ..... 162/72, 90, 40, 42, 162/37

[56] References Cited

U.S. PATENT DOCUMENTS

| | | | |
|---|---|---|---|
| 4,012,280 | 3/1977 | Holton | 162/72 |
| 4,127,439 | 11/1978 | Fujii et al. | 162/72 |
| 4,178,861 | 12/1979 | Van der Hoek | 162/72 |

FOREIGN PATENT DOCUMENTS

| | | | |
|---|---|---|---|
| 155202 | 12/1977 | Japan | 162/72 |

*Primary Examiner*—Mark S. Alvo
*Attorney, Agent, or Firm*—Stanley M. Teigland

[57] ABSTRACT

Lignocellulose is treated with an alkaline pretreatment liquor containing anthraquinone or other pretreatment agent in a continuous process in which the lignocellulose and pretreatment liquor flow countercurrently. The pretreatment agent is substantially soluble in the pretreatment liquor introduced into the pretreatment zone and is substantially insoluble in the pretreatment liquor withdrawn from the pretreatment zone, with the result that the pretreatment agent is effectively recycled within the pretreatment zone.

6 Claims, No Drawings

CONTINUOUS COUNTERCURRENT PRETREATMENT OF LIGNOCELLULOSE WITH ANTHRAQUINONE PRIOR TO PULPING

This is a continuation of application Ser. No. 97,076, filed Nov. 23, 1979, now abandoned.

U.S. Pat. No. 4,012,280 to Holton teaches that anthraquinone (AQ) promotes the delignification of lignocellulose when the AQ is added directly to the alkaline pulping liquor employed in the main delignification step. Our U.S. Pat. No. 4,127,439 discloses that the same beneficial effect of AQ in promoting delignification can be achieved by pretreating the lignocellulose with AQ prior to carrying out the main delignification step. The advantage of employing AQ in a pretreatment step is that the AQ can be recycled since, under the proper conditions, most of it survives the pretreatment step. In comparison, when AQ is employed in the main delignification step, it is substantially consumed.

The pretreatment process disclosed in our previous patent is based on the concept of separating the liquor from the lignocellulose before most of the AQ has been consumed, and then reusing the separated liquor to pretreat other lignocellulose. However, it has since occurred to us that when the pretreatment step is carried out in a continuous process, it is not necessary to reuse the liquor. In the continuous process of this invention, lignocellulose is continuously introduced at one end of a tubular pretreatment zone and withdrawn at the other end while an aqueous alkaline solution (pretreatment liquor) is continuously introduced at the end at which lignocellulose is withdrawn and then an aqueous solution is withdrawn at the end at which the lignocellulose is introduced. Hence, the flow of pretreatment liquor is countercurrent to the flow of the lignocellulose. Initially, upon start-up, an appropriate amount of AQ or other pretreatment agent is introduced into the pretreatment zone, preferably with the lignocellulose. When the pretreatment liquor reaches the end of the pretreatment zone at which the lignocellulose is introduced, the conditions are such that very little pretreatment agent is present in the pretreatment liquor that is withdrawn from the vessel. Since the liquor that is withdrawn contains very little pretreatment agent, and in addition is only weakly alkaline and contains dissolved organic material, it is better to dispose of the liquor than to recycle it.

Although the spent pretreatment liquor is disposed of, the pretreatment agent is nevertheless recycled. Instead of being recycled with the pretreatment liquor, as claimed in our previous patent, the pretreatment agent is recycled within the pretreatment zone. Recycle of the pretreatment agent within the pretreatment zone is achieved by establishing conditions at the end of the pretreatment zone at which the pretreatment liquor is introduced such that the pretreatment agent is substantially soluble in the pretreatment liquor, and by establishing conditions at the end of the pretreatment zone at which the pretreatment liquor is withdrawn such that the pretreatment agent is substantially insoluble in the pretreatment liquor. As the flowing pretreatment liquor approaches the end of the pretreatment zone at which the liquor is withdrawn, the pretreatment agent precipitates onto the lignocellulose which is introduced at the same end, and is carried back through the pretreatment zone with the lignocellulose. As the lignocellulose flows through the pretreatment zone, the pretreatment agent is dissolved back into the pretreatment liquor.

Dissolution of the pretreatment agent may be accompanied by formation of a more soluble reduced form of the pretreatment agent. Hence, when we refer to the solubility of the pretreatment agent, it is understood that the expression includes reduction of the pretreatment agent to a more soluble derivative.

Pretreatment agents having a quinone structure are substantially soluble in the pretreatment liquor at temperatures above about 90° C. when the alkali concentration (expressed as $Na_2O$) is greater than about 7 grams per liter of pretreatment liquor. Consequently, the pretreatment liquor introduced into the pretreatment zone preferably has an alkali concentration greater than about 7 grams per liter of pretreatment liquor. The alkali may be any suitable base, but the bases normally employed in alkaline pulping, such as sodium hydroxide, are preferred. The initial alkali concentration is preferably greater than about 50 grams per liter, and may be as high as 80 grams per liter, or more. In theory, there is no upper limit to the alkali concentration of the pretreatment liquor introduced into the pretreatment zone, but, as a practical matter, the maximum alkali concentration is determined by the need to have the alkali concentration at the other end of the pretreatment zone be such that the pretreatment agent is substantially insoluble in the pretreatment liquor. Preferably, this alkali concentration is such that the pH of the pretreatment liquor withdrawn from the pretreatment zone is less than about 13. More preferably, the pH is less than two pH units above the $pK_a$ of the reduced species of the pretreatment agent. For example, the reduced species of anthraquinone is anthrahydroquinone, which is estimated to have a $pK_a$ of 10. Hence, when anthraquinone is used as the pretreatment agent, the pH of the pretreatment liquor withdrawn from the pretreatment zone is preferably less than about 12. More preferably, the pH is less than the $pK_a$ of the reduced species.

The temperature of the pretreatment liquor also affects the solubility of the pretreatment agent, but, as a practical matter, the temperature of the pretreatment liquor withdrawn from the pretreatment zone is determined by the need to carry out the pretreatment at a temperature above 90° C. The pretreatment is preferably carried out at a temperature between about 100° C. and about 190° C. The pretreatment liquor withdrawn from the pretreatment zone is cooled somewhat by the incoming lignocellulose, and typically has a temperature between about 90° C. and 110° C.

The ratio of the rate of flow of the pretreatment liquor to the rate of flow of the lignocellulose, on a weight basis, is preferably about 0.2:1 to about 5:1. However, the ratio preferably does not exceed the weight ratio of the water in the lignocellulose to the total weight of lignocellulose introduced into the pretreatment zone. For example, if the lignocellulose contains 40% water, the ratio of the rate of flow of the pretreatment liquor to the rate of flow of the lignocellulose is preferably less than about 0.4:1.

The lignocellulose is preferably wood, but may be straw, bagasse, bamboo, hemp and the like.

The residence time of the lignocellulose in the pretreatment zone is limited so that the lignin content of the lignocellulose is reduced not more than about 20%. When the temperature of the pretreatment liquor is between about 90° C. and 140° C., this residence time is generally between about 5 and 60 minutes, and typically between about 10 and 30 minutes. Inasmuch as the lignin content of the lignocellulose is not reduced more than about 20%, the process of this invention is based on a different concept than processes wherein the same agent is added directly to the main pulping liquor, as in U.S. Pat. No. 4,012,280.

The pretreatment agent is anthraquinone or a compound which functions like anthraquinone in promoting the delignification of lignocellulose. Compounds which function like anthraquinone include those which reduce lignin intermediates formed during pulping and thereby prevent the lignin intermediates from condensing during pulping. Such compounds include not only those having a quinone structure, as disclosed in U.S. Pat. No. 4,012,280, but also certain other compounds, particularly amino compounds, as disclosed in other references.

The pretreatment agent is preferably selected from the group consisting of anthraquinone, dihydroanthraquinone, tetrahydroanthraquinone, anthrahydroquinone, anthrone and such compounds bearing alkyl, alkoxy, amino or halo substituents in the 1–8 positions. If the number of substituents is two or more, the substituents are preferably the same, but the number of substituents is preferably two or less. The alkyl and alkoxy substituents preferably have one to four carbon atoms. The halo substituent is preferably chloro. The substituted compounds give results which are generally at least as good as the results obtained with the unsubstituted compounds, but the substituted compounds are generally more expensive than the unsubstituted compounds.

The concentration of the pretreatment agent in the pretreatment zone is preferably maintained at between about 0.02 and 2.0 percent by weight based on the lignocellulose in the pretreatment zone. The concentration can be maintained by adding an appropriate amount of pretreatment agent to the pretreatment liquor introduced into the pretreatment zone to make up for the minor amount of pretreatment agent which is unavoidably lost in the pretreatment process.

The following example represents the best mode contemplated by us for carrying out the process of the invention.

EXAMPLE

Presteamed chips of Douglas fir at 90° C. and 50% moisture content are introduced into a tubular vessel at one end at a rate of 10,000 kilograms per hour. An aqueous pretreatment liquor having a temperature of 90° C. is fed into the vessel at the other end at a rate of 5,000 kilograms per hour. The pretreatment liquor has an alkali concentration of 80 grams per liter of liquor. Sufficient anthraquinone to maintain a concentration of anthraquinone in the vessel of 0.2% of the lignocellulose is introduced into the vessel.

The contents of the vessel are heated by external means to a temperature of 140° C. The residence time of the wood is 45 minutes. Spent pretreatment liquor is continuously withdrawn from the vessel at the end at which the wood is introduced. The liquor which is withdrawn has a temperature of 100° C., a pH of 12, and contains a negligible amount of anthraquinone. The treated wood is withdrawn from the vessel at the end at which the pretreatment liquor is introduced. The lignin content of the wood has not been reduced more than 20%. The pretreated wood is then digested with a digestion liquor containing 10% alkali, based on wood. The digestion liquor was heated to 170° C. and maintained at 170° C. for 110 minutes. The yield at a given Kappa number of the resulting pulp is higher than the yield obtained under comparable conditions without pretreatment with anthraquinone, and is comparable to the yield obtained when anthraquinone is added directly to the main delignification step. However, when anthraquinone is added to the main delignification step, it is substantially consumed, whereas in the process of this invention the anthraquinone is effectively recycled within the pretreatment zone. Hence, this invention provides a more efficient and economical utilization of anthraquinone (or compound which functions like anthraquinone) in promoting delignification of lignocellulose.

We claim:

1. A continuous process for pretreating lignocellulose with a quinone pretreatment agent wherein the pretreatment agent is recycled in the process, which process comprises continuously introducing the lignocellulose into one end of a tubular pretreatment zone and withdrawing it at the other end, continuously introducing an aqueous alkaline solution having an alkali concentration greater than 7 grams per liter of the solution into the pretreatment zone at the end at which the lignocellulose is withdrawn and withdrawing the aqueous solution at the end at which the lignocellulose is introduced wherein the pH of the aqueous solution withdrawn from the pretreatment zone is less than two pH units above the pKa of the reduced form of the pretreatment agent, maintaining in the pretreatment zone a concentration of the pretreatment agent of about 0.02 to 2.0 percent by weight based on the lignocellulose in the pretreatment zone, limiting the residence time of the lignocellulose in the pretreatment zone so that the lignin content of the lignocellulose is reduced not more than about 20%, establishing conditions at the end of the pretreatment zone at which the aqueous alkaline solution is introduced such that the pretreatment agent is substantially soluble in the aqueous alkaline solution, establishing conditions at the end of the pretreatment zone at which the aqueous solution is withdrawn such that the pretreatment agent is substantially insoluble in the aqueous solution, with the result that as the aqueous alkaline solution approaches the end of the pretreatment zone at which the aqueous solution is withdrawn, the pretreatment agent precipitates onto the lignocellulose which is introduced at the same end, and that as the lignocellulose flows through the pretreatment zone, the pretreatment agent is dissolved back into the aqueous alkaline solution, whereby the pretreatment agent is effectively recycled within the pretreatment zone, the pretreatment agent being anthraquinone or other compound having a quinone structure which promotes the delignification of lignocellulose.

2. The process of claim 1 wherein the process is carried out at a temperature between 90° C. and 190° C.

3. The process of claim 1 wherein the ratio of the rate of flow of the pretreatment liquor to the rate of flow of the lignocellulose is between about 0.2:1 to 5:1.

4. The process of claim 1 wherein the pretreatment agent is selected from the group consisting of anthraquinone, dihydroanthraquinone, tetrahydroanthraquinone, anthrahydroquinone, anthrone, and said compounds having alkyl, alkoxy, amino, or halo substituents in the 1–8 positions.

5. The process of claim 1 wherein the pretreatment agent is anthraquinone.

6. The process of claim 1 wherein the alkali concentration of the aqueous alkaline solution introduced into the pretreatment zone is greater than about 50 grams per liter of solution.

* * * * *